United States Patent [19]

Harvath

[11] 3,949,816

[45] Apr. 13, 1976

[54] UTILITY IMPACT WRENCH

[76] Inventor: Frank B. Harvath, 6028 St. Clair Ave., Cleveland, Ohio 44103

[22] Filed: May 15, 1975

[21] Appl. No.: 577,692

[52] U.S. Cl. ..... 173/93; 81/52.3
[51] Int. Cl.[2] ..... B25D 15/00
[58] Field of Search ..... 81/52.3; 173/93

[56] References Cited

UNITED STATES PATENTS

| | | | |
|---|---|---|---|
| 2,793,551 | 5/1957 | Ford | 173/93 |
| 2,882,772 | 4/1959 | Potter | 173/93 |
| 3,157,074 | 11/1964 | Durkee | 173/93 |
| 3,158,050 | 11/1964 | Shandel | 173/93 |

*Primary Examiner*—James L. Jones, Jr.
*Attorney, Agent, or Firm*—Baldwin, Egan, Walling & Fetzer

[57] ABSTRACT

An impact wrench is described as having a short spindle with means on one end to engage a threaded object to be turned, such as a bolt securing an automobile wheel in position, with a moment arm pivotally mounted at the other end of the spindle. A linear weight guide is rigidly mounted on this arm at a right angle thereto at the end opposite the pivot. A weight embraces the guide and is easily slidable thereon so that the spindle-mounted wrench means may be engaged with the object to be turned, after which the moment arm may be swung about the pivot connection to a position where the weight slides along the guide, after which stop means at either end of the guide will cause the weight to stop suddenly responsive to resistance of the threaded object so as to apply an impact to the object at right angles to the axis of the threads.

2 Claims, 7 Drawing Figures

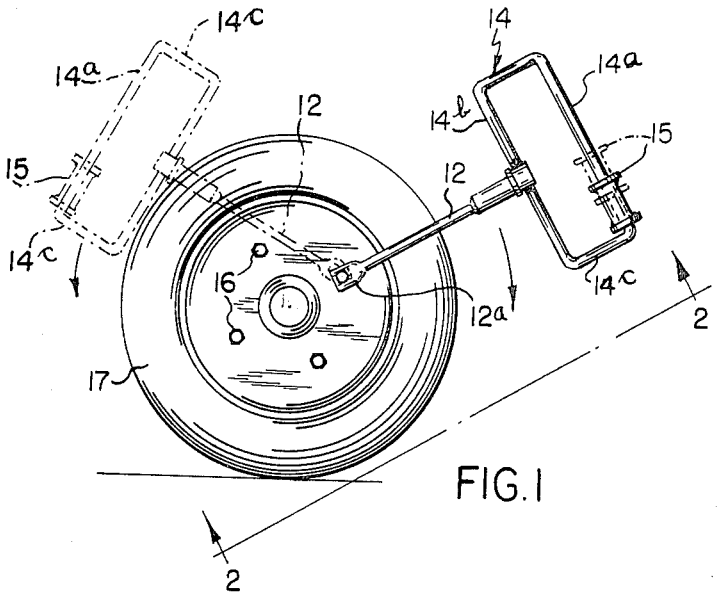
FIG.1
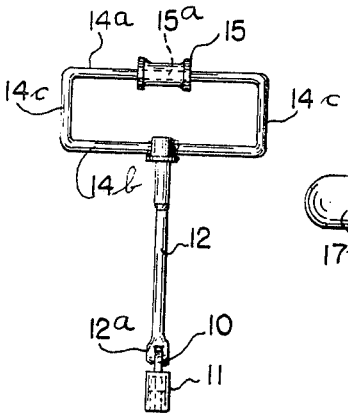
FIG.3
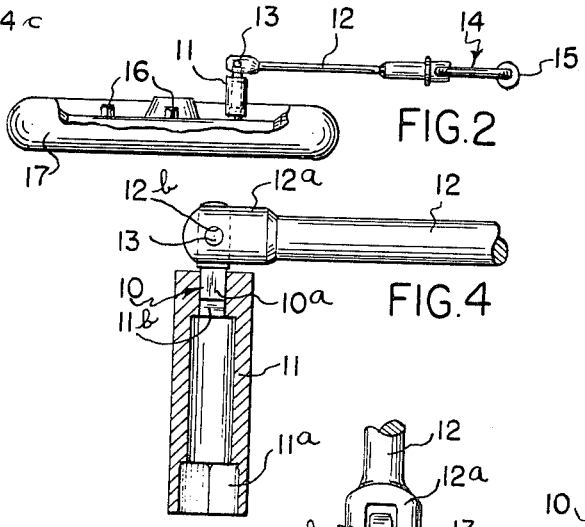
FIG.2
FIG.4
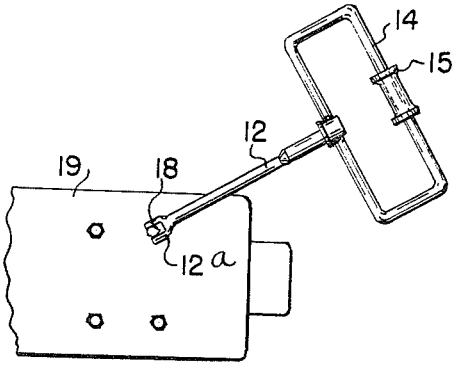
FIG.7
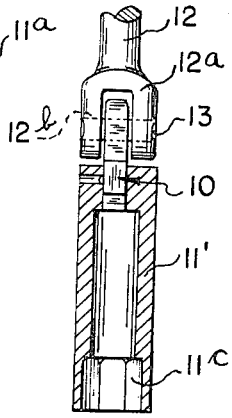
FIG.5
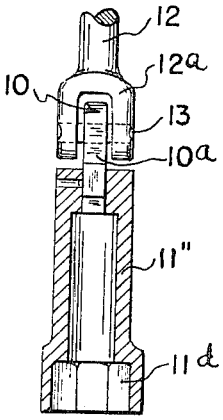
FIG.6

UTILITY IMPACT WRENCH

An object of the present invention is to provide a simple means to engage a threaded object such as a bolt fastening an automobile wheel having a wrench type end of a spindle attached to the bolt head and a moment arm having a pivot connection with the spindle running out at right angles to the spindle carrying with it a linear guide at right angles to the moment arm with a slidable weight on the linear section. Then, when the bolt threads create sufficient resistance, the moment arm will be stopped suddenly and the weight will slide along the linear guide to an end of the guide then in a lower position and the sudden stopping of the device will deliver a sharp impact to the bolt head, thus tightening the bolt as desired.

Other objects and advantages of this invention will be apparent from the drawings and description and the essential features thereof will be set forth in the appended claims.

In the drawings,

FIG. 1 is a side elevational view of the device attached to a bolt in the full line position, and swung about the pivot point to a dot-dash position to deliver the impact;

FIG. 2 is an end elevation taken along the line 2—2 of FIG. 1;

FIG. 3 is an end elevation of the device with the spindle in line with the moment arm;

FIGS. 4, 5 and 6 are fragmental sectional views showing various wrench heads which may be attached to the spindle; while FIG. 7 is a plan view showing the device in position to operate on a bolt not associated with an automobile wheel.

Referring to FIGS. 1 through 4, the device includes a spindle 10 having a non-circular end 10*a* adapted for easy attachment to a wrench type end 11 which has an end 11*a* fitted to provide a non-circular recess adapted to fit over a bolt head. A moment arm 12 has a bifurcated end 12*a* through which pass aligned openings 12*b* through which a pivot pin 13 is passed, this pin also passing through a suitable opening in the spindle 10. The pin is secured in position by any suitable means, but it is herein shown as being a press fit in the openings 12*b*. The moment arm 12 is of such a length as to give the opportunity to supply a suitable force to turn the bolt engaged by the recess 11*a*, say usually at least about 12 inches or more in length. At the outer end of the moment arm, there is rigidly attached a linear guide 14*a* which is rigidly secured to the outer end of the moment arm 12 in any suitable manner so as to allow freedom for travel of the weight 15 along the guide 14*a*. A satisfactory structure is shown as comprising an elongated rectangle 14 of bar material which provides the linear guide 14*a* on one of the longer sides and the other long side 14*b* is connected, preferable at its center, to the end of the arm 12 in any suitable manner such as a press fit, or welding, or the like.

The weight 15 may be of spool shape as shown but in any case has a central through opening 15*a* which is of a size to slide easily on the linear guide 14*a*.

FIGS. 1 and 2 show the device used in connection with loosening or tightening one of the bolts 16 used to hold the automobile wheel 17 in its driving position. In this case, the non-circular end 10*a* of the spindle 10 is inserted into a receiving recess 11*b* of the wrench portion 11 and the recess 11*a* is fitted over the bolt head to be manipulated. The moment arm 12 is then swung about the pivot point 13 to a position approximately at right angles to the spindle 10 to lie in the position shown in dot-dash lines in FIG. 1. At this time the weight 15 would be in the dot-dash line position shown there. If the operator is tightening the bolt, it will be presumed that he has turned the bolt by his fingers, or otherwise, to a position where the threads of the bolt begin to take hold. The operator then swings the moment arm 12 from the dot-dash line position of FIG. 1 to the full line position which places the linear guide 14*a* in a position where the weight 15 is free to slide downwardly. The weight 15 will then strike one of the short ends of the rectangle member 14, as indicated at 14*c*, thus causing the weight 15 to deliver a sharp impact to the bolt 16 at right angles to the axis of the threads of the bolt. This, of course, is due to the kinetic energy of the moving weight 15.

If the operator were trying to loosen a tight bolt 16, he would probably first place the device in the dot-dash position of FIG. 1 and manually move the weight 15 along the linear guide 14*a* from top to bottom to deliver a few sharp blows by the weight striking the stop means 14*c* until he got the threads loosened slightly, after which he would move the end 10*a* in the recess 11*b* to place the device toward the right in the full line position of FIG. 1 and then swing the arm from left to right until the bolt 16 was sufficiently loose to turn the bolt out.

FIG. 4 shows the recess 11*a* adapted to fit a bolt with a square head, FIG. 5 shows a wrench end 11*c* adapted to fit a small hex head bolt while the member shown in FIG. 6 has a larger hex head opening 11*d* to receive a larger bolt head.

In FIG. 7, a device exactly like that described is shown having the fixture 11 applied to a bolt 18 which is to be turned in a suitable opening in the body 19 in which the bolt is embedded.

Thus, the invention provides a simple device with few parts which are unlikely to get out of order. The tool can be easily stored in a small space and can be quickly applied to a bolt which the operator desires to loosen or tighten.

What is claimed is:

1. An impact wrench comprising a short spindle, means on the end of said spindle for engaging a threaded object to be turned, a moment arm pivotally mounted on the end of said spindle, a linear weight guide rigidly mounted on said arm at a right angle thereto at the end opposite said pivot, and a weight embracing said guide and easily slidable thereon, whereby said spindle means may be engaged with an object to be turned and said moment arm may be swung about said pivot point to a position where said weight slides along said guide, and stop means at each end of said guide causing said weight to stop suddenly responsive to resistance to said threaded object to apply an impact to said object at right angles to the axis of said threads.

2. An impact wrench as defined in claim 1, wherein said weight guide comprises a bar in the form of an elongated rectangle having one long side fixed to said moment arm, and said weight embracing the other long side.

* * * * *